US007775959B2

(12) United States Patent
Schalk

(10) Patent No.: US 7,775,959 B2
(45) Date of Patent: Aug. 17, 2010

(54) FOLDING DEVICE WITH A FOLDING DRUM

(75) Inventor: Hubert Schalk, Thierhaupten (DE)

(73) Assignee: MAN Roland Druckmaschinen AG, Offenback am Main (DE)

( * ) Notice: Subject to any disclaimer, the term of this patent is extended or adjusted under 35 U.S.C. 154(b) by 612 days.

(21) Appl. No.: 10/816,524

(22) Filed: Apr. 1, 2004

(65) Prior Publication Data

US 2005/0003943 A1 Jan. 6, 2005

(30) Foreign Application Priority Data

Apr. 2, 2003 (DE) ..... 103 14 945

(51) Int. Cl.
*B31B 1/10* (2006.01)

(52) U.S. Cl. ..... 493/429; 493/405; 493/424; 493/425; 493/434; 493/442

(58) Field of Classification Search ..... 493/405, 493/424, 425, 429, 434, 442
See application file for complete search history.

(56) References Cited

U.S. PATENT DOCUMENTS

| | | | | |
|---|---|---|---|---|
| 1,471,755 | A | 10/1923 | Schmidt | |
| 1,481,252 | A | 1/1924 | Christman et al. | |
| 2,919,914 | A * | 1/1960 | Harless | 493/431 |
| 3,020,042 | A | 2/1962 | Worthington et al. | |
| 5,118,214 | A * | 6/1992 | Petrzelka et al. | 403/267 |
| 5,741,209 | A * | 4/1998 | Hillebrand et al. | 493/424 |
| 5,873,808 | A * | 2/1999 | Piller et al. | 493/424 |
| 6,298,948 | B1 * | 10/2001 | Junghans et al. | 184/6.1 |
| 6,527,029 | B1 * | 3/2003 | Ryser | 156/556 |
| 6,688,224 | B2 * | 2/2004 | Herda et al. | 101/227 |
| 6,740,022 | B2 * | 5/2004 | Hachiya et al. | 493/424 |
| 2002/0147092 | A1 * | 10/2002 | Bergeron et al. | 493/227 |

FOREIGN PATENT DOCUMENTS

| | | | |
|---|---|---|---|
| DE | 196 29 674 C1 | | 1/1998 |
| JP | 58-52146 | * | 3/1983 |

OTHER PUBLICATIONS

English Abstract of JP58052146.
French Search Report.

* cited by examiner

*Primary Examiner*—Hemant M Desai
(74) *Attorney, Agent, or Firm*—Cohen Pontani Lieberman & Pavane LLP

(57) ABSTRACT

A folding device with a folding drum for producing the second longitudinal fold in products of a rotary press has at least two folding blades fixed in folding-blade carriers, a folding-blade shaft is mounted in the folding drum at both ends by means of bearings and between the latter by means of at least one further bearing, the bearing preferably being arranged between the folding-blade carriers.

14 Claims, 2 Drawing Sheets

FOLDING DEVICE WITH A FOLDING DRUM

BACKGROUND OF THE INVENTION

1. Field of the Invention

The invention relates to a folding device with a folding drum for producing the second longitudinal fold in products which have been produced with a rotary press.

2. Description of the Related Art

The basic construction of a folding device which comprises a folding drum is disclosed in U.S. Pat. No. 2,919,914. The folding device of this reference includes a folding blade which is secured in the folding drum and is moved into the region between two folding rolls and out again on a cycloid path. During the process, the folding blade presses the product to be folded into a gap between two folding rolls. The folding blade is fastened to a folding-blade carrier arranged on a folding-blade shaft. Both ends of the folding-blade shaft are mounted in the folding drum so that the folding blade is mounted at two points.

High flexural loading of the folding-blade shaft results from a high rotational velocity of the folding drum such that the folding-blade shaft discernibly deflects in the central region and the folding quality thus becoming worse as the velocity increases.

SUMMARY OF THE INVENTION

It is an object of the invention to provide a folding device which makes higher folding speeds possible without reducing the folding quality.

The object is achieved according to the invention using a folding device having a folding-blade shaft having two ends, wherein both ends are rotatably mounted in a folding drum. The folding-blade shaft has at least two folding-blade carriers for holding folding blades. The folding-blade shaft is mounted in the folding drum at both ends by bearings and between the ends by at least one further bearing, wherein the at least one further bearing is preferably being arranged between the folding-blade carriers.

One substantial advantage of the folding device is that the folding-blade shaft is configured with at least one further bearing point in the region between the bearing points at the two ends. At least two folding-blade carriers are arranged on the folding-blade shaft, wherein the at least on further bearing point which is arranged between the bearings at the two ends is preferably arranged between the folding-blade carriers.

Another advantage of a folding-blade shaft of this type, which is configured with at least three bearing points, is that it is possible to counteract a deflection of the folding-blade shaft in the central region. Production is possible at an increased rotational speed over the prior art as a result of the reduction of the deflection of the folding-blade shaft and of the folding blades arranged on the said folding-blade shaft by the folding-blade carriers. The bearing points are preferably configured with self-aligning roller bearings. The bearings can be supplied with lubricating medium, preferably grease, by a central lubricating-medium supply means.

It is possible to reduce the weight of the entire folding device, preferably the folding drum and/or the folding-blade shaft with the folding-blade carrier, as a result of the at least one further bearing point arranged between the bearings at the two ends, as the forces resulting from the rotation are distributed over at least three bearing points. The distribution of forces over at least three bearing points allows the folding drum to be designed with a smaller wall thickness to accommodate the bearings serving to mount the folding-blade shaft at the two ends, such that the overall mass of the folding drum is reduced. High overall rigidity of the folding-blade shaft with blade holding means and a reduction in the overall mass of the folding-blade shaft, folding-blade carrier and folding blade with a simultaneous reduction in the manufacturing costs can also be achieved by mounting the folding-blade shaft using the at least three bearing points. It is possible to increase the service life of the bearings at an identical rotational speed and to increase the rotational speed with identical loading of the bearings as a result of the reduction in the overall mass of the folding-blade carrier including the folding-blade shaft and folding drum. The lower weight of the folding-blade carrier, in particular, increases the service life of the bearings. The mass of the folding drum is also reduced again overall, as a smaller rotating mass has to be balanced. This in turn reduces the required drive power and, in some circumstances, the manufacturing costs.

The rotational motion of the folding-blade shaft is advantageously introduced via a spur gear which serves as a drive pinion and is arranged on the folding-blade shaft by form-fitting serrated toothing. This form-fitting connection between the folding-blade shaft and spur gear increases the reliability of the introduction of motion.

Furthermore, the consequences of the additional bearing in the central region of the folding-blade shaft which accommodates the folding-blade carrier are a smaller deflection of the folding-blade carrier, less oblique positioning of the drive pinion and the possibility of reducing the tooth play. The folding accuracy is increased as a result of the smaller tooth play.

It is significant that the carrier for accommodating the at least one additional bearing in the central region of the folding-blade shaft is firstly configured with a small material thickness in the longitudinal direction of the folding device and secondly, however, the carrier is configured with a large area which extends over approximately the entire cross section of the interior of the folding drum in the transverse direction of the folding device, in such a way that the stability and torsional rigidity are ensured despite the small material thickness.

One advantage of the small material thickness of the at least one carrier is that it is possible to arrange the folding blades very close to one another in the region of the carrier, the gap between the folding blades preferably being smaller than 10 millimeters.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
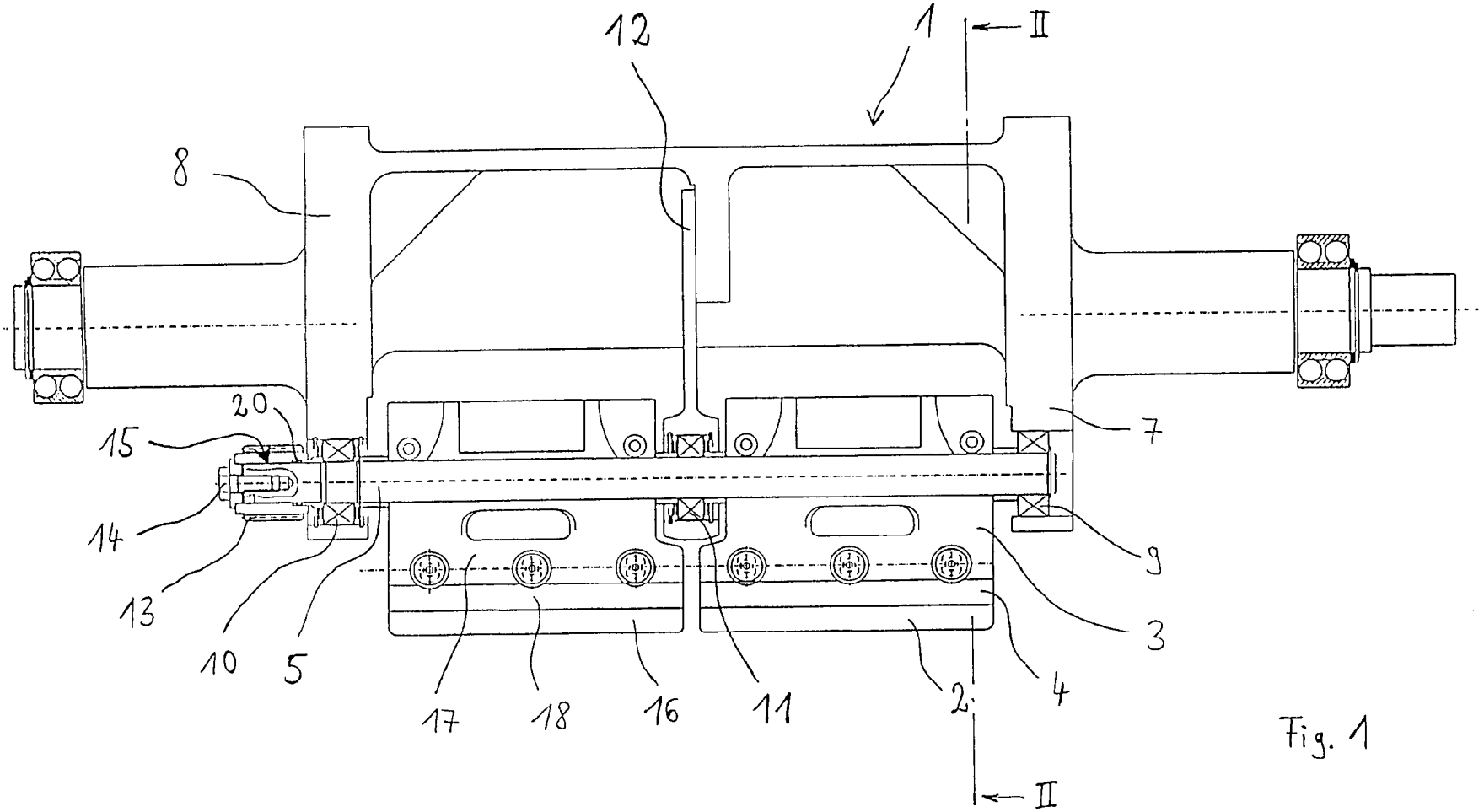
FIG. 1 is a sectional view along a longitudinal axis of a folding device with a folding drum.

FIG. 1 shows a folding device with a folding drum 1. The folding device may be used to produce a second longitudinal fold in products which have been produced with a rotary press. It is also possible, however, to fold sheets.

Figure 2:
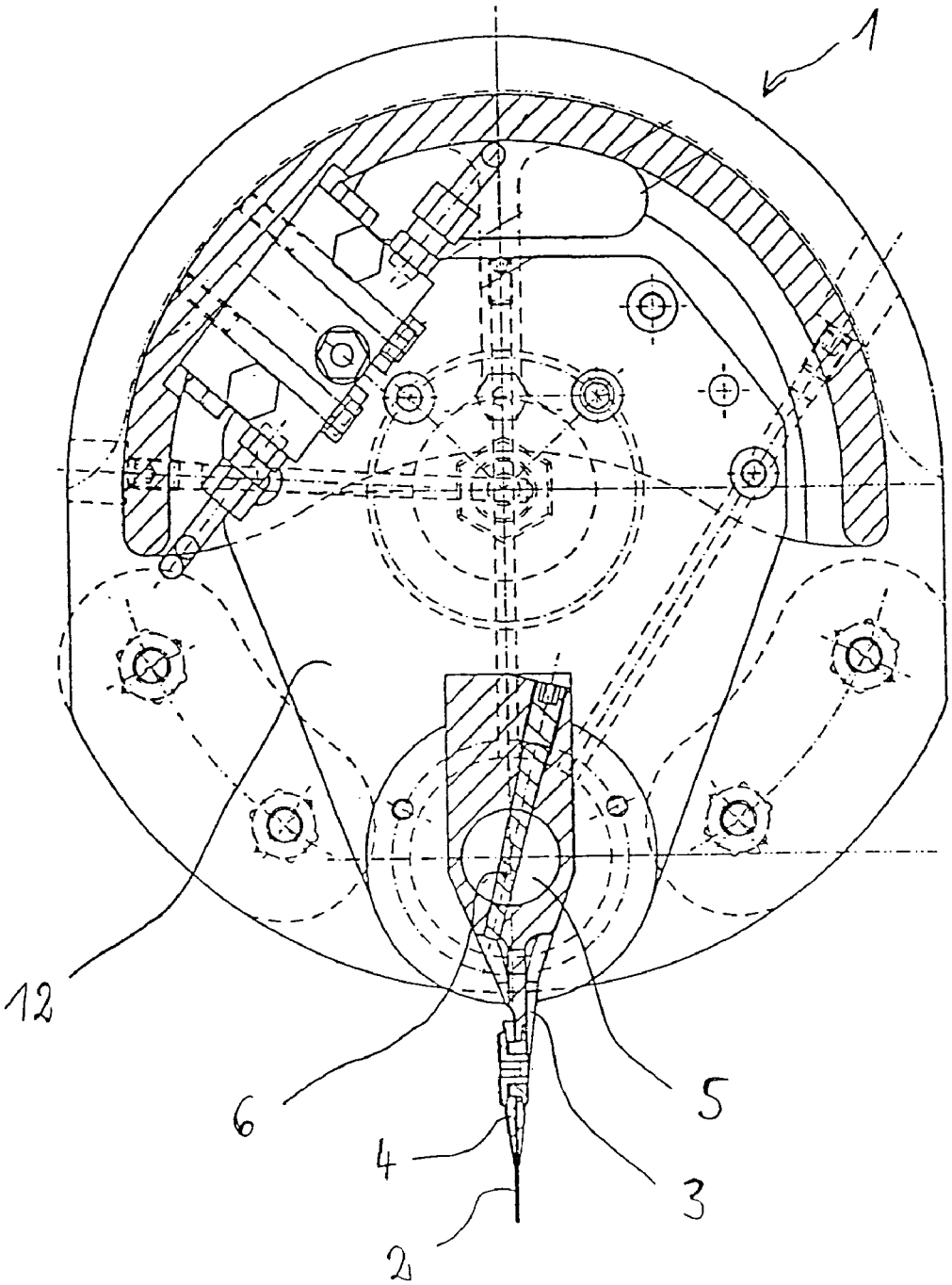
FIG. 2 is a sectional side view of the folding device according to FIG. 1.

The folding drum 1 comprises two folding blades 2, 16 which are each clamped in a folding-blade carrier 3, 17 (see FIG. 2). The folding blade 2, 16 comprises a planar, thin metal sheet and has a thickness of less than 1 mm such as, for example, a thickness of 0.5 mm. It is made from a fine metal sheet (strip steel) delivered as a semi-finished product without its upper and lower side having been processed. The contour of the folding blade 2, 16 can be produced simply using laser cutting and its front edge is advantageously slightly bevelled.

The folding blade 2, 16 is clamped between a surface of the folding-blade carrier 3, 17 and the surface of a clamping strip 4, 18, the clamping strip 4, 18 being screwed to the folding-blade carrier 3, 17. The folding-blade carrier 3, 17 is arranged on a folding-blade shaft 5 and the folding-blade shaft 5 is rotatably mounted in the folding drum 1.

The folding-blade carrier 3 is advantageously connected to the folding-blade shaft 5 by a pin connection 6 (see FIG. 2). The folding blade carrier 17 is similarly connected using a separate pin connection similarly to the connection of folding-blade carrier 3 shown in FIG. 2. The folding blades 2, 16 are produced in one operation before being installed in the folding drum 1. In this production process, the unprocessed folding blades 2, 16 are fastened in the respective folding-blade carrier 3, 17, the folding-blade carriers 3, 17 being arranged on the folding-blade shaft 5, preferably clamped, and being secured in their position relative to one another using the pin connection 6. The said pin connection 6 serves to locate the exact position of the finally processed folding blade 2, 16 or the folding blades 2, 16 with respect to one another during installation in the folding drum 1.

At its ends or at least in the region of its ends, the folding-blade shaft 5 is mounted in side walls 7, 8 of the folding drum 1 by bearings 9, 10. The folding-blade shaft 5 is additionally mounted between the two folding-blade carriers 3, in this case in the centre, by a further bearing 11 which is arranged in a carrier 12. The carrier 12 is connected to the folding drum 1 and is preferably screwed to the folding drum 1 (FIG. 2). The carrier 12 comprises a thin sheet-metal blank which has a relatively large area, the carrier 12 extending over virtually the entire cross section of the interior of the folding drum 1. The material thickness of the thin sheet-metal blank of the carrier 12 is preferably configured to at least correspond to the bearing-eye thickness of the bearing 11 which is attached there.

The bearings 9 to 11 are preferably configured as self-aligning roller bearings, it being possible to supply the latter (in a manner not shown in greater detail) with lubricating medium, preferably grease, by a central lubricating-medium supply means via supply channels, supply bores or supply lines which are arranged on or in the side walls 7, 8 and in the carrier 12.

At one end of the folding-blade shaft 5 there is arranged a drive pinion 13 which is secured to the folding-blade shaft 5 by a screw connection 14. The drive pinion 13 is connected to the folding-blade shaft 5 with a form-fitting connection by serrated toothing 15. A clamping element 20 provides the force-transmitting connection between the drive pinion 13 and folding-blade shaft 5.

The form-fitting connection between the folding-blade shaft 5 and the spur gear configured as a drive pinion 13 increases the reliability of the introduction of motion.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A folding device for producing a second longitudinal fold in products of a rotary press, comprising:

a folding drum comprising two opposing side walls and a carrier connected to the folding drum at a location between said side walls, wherein said carrier has a small material thickness in a longitudinal direction of said folding device and a large area extending approximately over an entire cross section of an interior of said folding drum in a transverse direction of said folding device;

a folding-blade shaft having two ends, each of said two ends of said folding-blade shaft being rotatably mounted in a respective one of said sides walls in said folding drum, said folding-blade shaft having at least two folding-blade carriers for holding folding blades which are spaced apart from one another in a region proximate said carrier by a distance smaller than 10 millimeters;

a pair of bearings arranged in said side walls of said folding drum, said ends of said folding-blade shaft being mounted respectively in said side walls by said pair of bearings;

at least one further bearing arranged in said carrier, wherein said folding-blade shaft is further rotatably supported in said carrier by said at least one further bearing between said ends of said folding-blade shaft, wherein said pair of bearings and said at least one further bearing comprise self-aligning roller bearings.

2. The folding device of claim 1, wherein said at least one further bearing is arranged between adjacent ones of said at least two folding-blade carriers.

3. The folding device of claim 1, wherein said pair of bearings and said at least one further bearing are operatively arranged for receiving lubricating medium from a central lubricating-medium supply.

4. The folding device of claim 1, wherein said carrier is connected to said folding drum by threaded connectors.

5. The folding device of claim 1, further comprising a drive pinion arranged on said folding-blade shaft, said drive pinion being connected to said folding-blade shaft with a form-fitting connection by serrated toothing.

6. The folding device of claim 5, further comprising a clamping element providing a force-transmitting connection between said drive pinion and said folding-blade shaft.

7. The folding device of claim 5, further comprising a screw connection securing said drive pinion to said folding-blade shaft.

8. The folding device of claim 5, further comprising a screw connection securing said drive pinion to said folding-blade shaft from a first side, and a clamping element providing a force-transmitting connection between said drive pinion and said folding-blade shaft from a second side, thereby preventing a translational movement of said drive pinion along a longitudinal direction of said folding-blade shaft.

9. A folding device for producing a second longitudinal fold in products of a rotary press, comprising:

a folding drum having a longitudinal axis and comprising two opposing side walls and a drum wall extending longitudinally between said side walls, said drum wall having a C-shaped cross section defining a circumferential gap between circumferential ends along a longitudinal length thereof;

a folding-blade shaft having two ends, each of said two ends of said folding-blade shaft being rotatably mounted in a respective one of said sides walls in said folding drum, said folding-blade shaft having at least two folding-blade carriers for holding folding blades; and a carrier connected to said drum wall, said carrier extending transverse to said longitudinal axis and rotatably supporting said folding-blade shaft at a location between said side walls, wherein said carrier has a small material thickness in a longitudinal direction of said folding device and a large area extending approximately over the entire cross section of an interior of said folding drum, and said folding blades being spaced apart from one another in a region proximate said carrier by a distance smaller than 10 millimeters.

10. The folding device of claim 9, wherein said drum wall has a projection extending radially inward and said carrier is connected to said projection on said drum wall.

11. The folding device of claim 10, wherein said carrier is connected to said projection using threaded connectors.

12. The folding device of claim 9, further comprising a pair of bearings arranged in said side walls of said folding drum, said ends of said folding-blade shaft being mounted respectively in said side walls by said pair of bearings; and at least one further bearing arranged in said carrier, wherein said folding-blade shaft is further rotatably supported in said folding drum by said at least one further bearing between said ends of said folding-blade shaft.

13. The folding device of claim 12, wherein said pair of bearings and said at least one further pair of bearings comprise self-aligning roller bearings.

14. The folding device of claim 9, wherein said carrier comprises a sheet-metal blank.

* * * * *